US005806122A

United States Patent [19]

Bogle et al.

[11] Patent Number: 5,806,122

[45] Date of Patent: Sep. 15, 1998

[54] AUTOMATIC GOLF BALL WASHER CADDY

[76] Inventors: Evard Bogle, 19 Jennifer Court, Bradford, Ontario, Canada, L3Z 2E8; Narayan Jariwala, 32 Crooked Stick Rd, Concord, Ontario, Canada, L4K 1P5

[21] Appl. No.: 752,086

[22] Filed: Dec. 2, 1996

[51] Int. Cl.[6] ..... A63B 47/04

[52] U.S. Cl. ..... 15/21.2; 15/88.1; 221/199; 221/298; 221/301

[58] Field of Search ..... 15/21.2, 88.1; 221/199, 298, 301

[56] References Cited

U.S. PATENT DOCUMENTS

| | | | |
|---|---|---|---|
| 1,793,658 | 2/1931 | Wilson | 15/21.2 |
| 3,044,089 | 7/1962 | Boynton | 15/21.2 |
| 5,400,455 | 3/1995 | Crossley | 15/21.2 |

*Primary Examiner*—Mark Spisich

[57] ABSTRACT

This invention relates to a more improved Golf Ball Cleaner, ball storage with accessories such as a clipboard, area for storing tees, pencil, liquid solution and a towel. This invention is an Automatic Golf Ball Washer Caddy. This Golf Ball Washer can be used on a stationary surface, attached to a golf cart, golf bag or a power driven cart. With the aid of an electronic timer and/or a conventional switch, the primary objective of this invention is to provide an improved ball cleaner that can be used anywhere or anytime. The ball is therefore placed in the receiving chamber by a cradle. This chamber has brushes strategically placed as to promote effective ball rotation. The cleaning action is realized by the ball travelling upward and downward by a motor, shaft and a spring. The ball is rubbed against the imbedded brushes causing a cleaning action. This cleaning process is aided with a battery as a power supply, attached to a motor, turning a special design shaft connected to an upright shaft striking the ball upwards and a spring that forces the ball downwards.

16 Claims, 6 Drawing Sheets

AUTOMATIC GOLF BALL WASHER CADDY

BACKGROUND OF THE INVENTION

1. Field of Invention

The present invention relates to an apparatus for cleaning golf ball or any other similar rounded objects, anywhere or anytime. It also created to aid the golfer in storing their accessories conveniently.

2. Description of Prior Art

There has been numerous golf ball cleaners known to us by various inventors, which many have been successful. There is no doubt that some portable ball cleaners has developed leakage, some are not automatic and some are too manually operated. In golf, a dirty ball can have adverse effect on the outcome of the scores, therefore it is extremely advantageous and necessary to have a clean and dry ball.

U.S. Pat. No. 5,524,311: Crossley described a hand held battery powered golf ball washer, with u-shaped rotatable brushes within the ball receiving chamber. Within the said chamber are brushes that is attached to two separate spine to accommodate bristles for cleaning golf ball.

U.S. Pat. No. 5,077,854: Wilhelmus A. Moons describe an apparatus for automatically cleaning and dispensing golf balls. This invention is perceived as fixed in one location or capable of transferring to another but not portable.

U.S. Pat. No. 3,004,089: B. C. Boynton shows the invention of a golf ball washer that is portable. The cleaning is realized when a golf ball enters in the washing drum, located in the sealed chamber. The ball is moved downwards and returned by aid of a spring, and at the same time rotating the golf ball causing cleaning. Although, this golf ball washer is portable, the cleaning action is not automatically done.

U.S. Pat. No. 4,965,906 Edward Mauro describe a combination golf ball and club head cleaner. The cleaning of the golf ball is realized when held in a ball holder for submerging in a cleaning chamber. The chamber has brushes embedded in side of it's walls, and by moving the ball upwards and downwards against the brushes, cleaning is achieved. This action is not said to be automatically done.

U.S. Pat. No. 4,750,232 Richard R. Doney described a portable golf ball cleaner. The cylindrical housing has removable brushes in the form of a rolled carpet, that fits around the cylindrical housing. The ball is held by a prong with enough pressure to allow the ball to turn. The prong is therefore enter into the chamber, rubbing against the brushes causing cleaning action. This process is not automatically done.

U.S. Pat. No. 4,442,564 William J. Berry describe a portable golf ball cleaner with the housing having fixed bristles all around its wall inwardly. More bristles are attached to the cover of cleaning chamber compartment forming a nest to received the golf ball. The ball is cleaned when the handle is manually rotated, rotating a golf ball against the brushes.

The aforementioned arts offers some similarities, that is, some are portable, some moved the ball upwards and downwards, some rotate the balls, some rotate the chamber, some are manual and some are automatically operated. Within the present invention, are a timer, a drain pipe, clip-board and storage accessories that will give the golfer everything he needs at his finger tips,

SUMMARY OF THE INVENTION

The present invention focuses on cleaning golf balls or any other similar rounded objects. It is capable of being affixed to a golf cart, pole, golf bag or on any surfaced. It also exhibits a clipboard for recording scores, a ring for hanging a towel, compartments for golf tees, liquid solution, pencil, and a compartment for storing golf balls. This compartment is designed to allow only one ball to release at a time, while preventing any other ball to be released. The cleaning chamber has bristles affixed to its sides and is sealed off by a flexible rubber gasket. The chamber also have a drain pipe to release liquid solution, without detaching or turn chamber up-side down. The special design cover has a cradle for holding a golf ball and submerging into cleaning chamber. This cover also have a spring for a return action. The cleaning action is realized when power is supplied to a motor, which turns a shaft(s), pushing a ball upwards, while the spring force said ball downwards. During this action, the ball rubs against the strategically placed bristle causing rotation and cleaning. In the described invention, there is a golf ball compartment for storage and carrying golf balls.

The invention exhibits a clipboard for keeping score cards a ring for hanging a towel for cleaning golf balls and compartments for pencil, tees and liquid solution.

The fixed bristles are strategically placed to enhance the rotation of the golf ball during the cleaning process.

The invention illustrates a versatile portable golf ball cleaner and caddy. Its provides a golfer the opportunity to have a clean ball all the time.

The invention also exhibits a motorized means of washing a golf ball, which can also be done through a timer. This motorized means is powered by a battery(s) or solar, as golf is a fair weather sport. With the existence of modern technology, this golf ball cleaner will be cost effective and simple to operate.

BRIEF DESCRIPTION OF THE DRAWINGS

Trough the creative features and uniqueness of this present invention it will become apparent from the specification taken in conjunction with the accompanying drawings, wherein;

" in FIG. 7.

LIST OF REFERENCE NUMERALS

Figure 1:
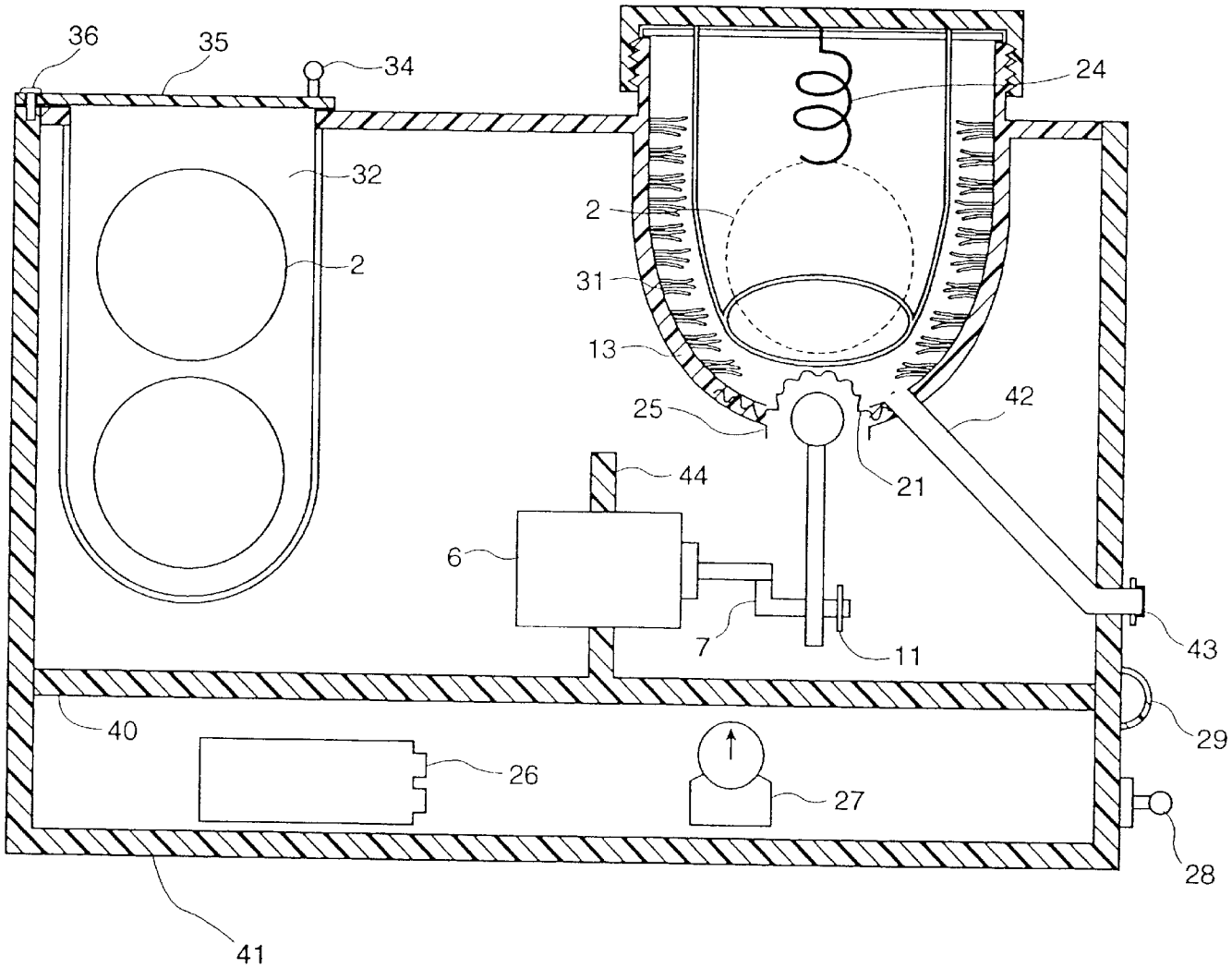
FIG. 1. is the sectional front view showing the embodiments of the Automatic Golf Ball Washer Caddy.
Figure 2:
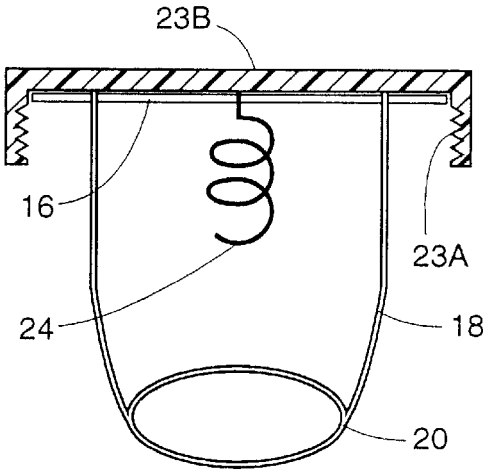
FIG. 2. is a sectional front view of the cover for ball washing chamber.
Figure 3:
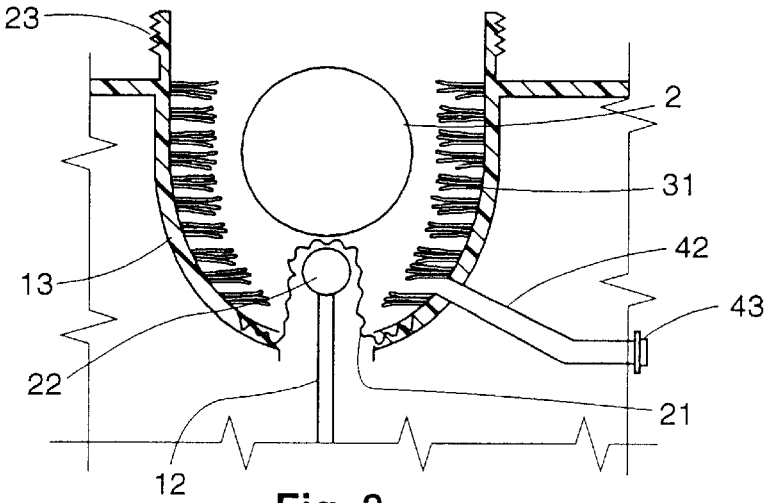
FIG. 3. is a sectional front view of golf ball 2 in cleaning chamber.
Figure 4:
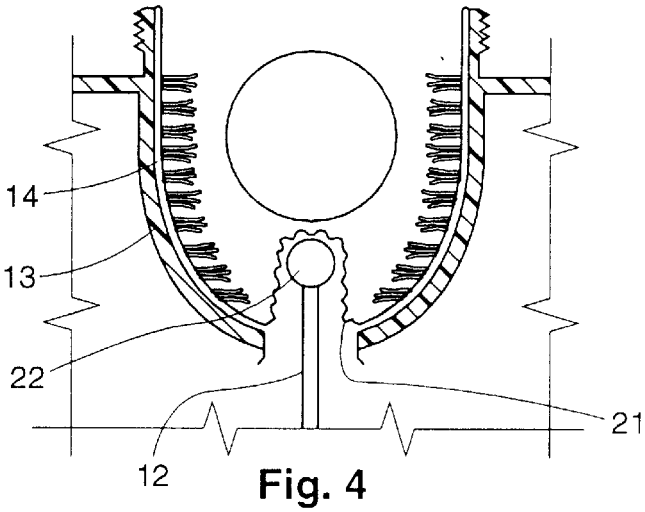
FIG. 4. is a sectional front view of removable sealed chamber 14.
Figure 5:
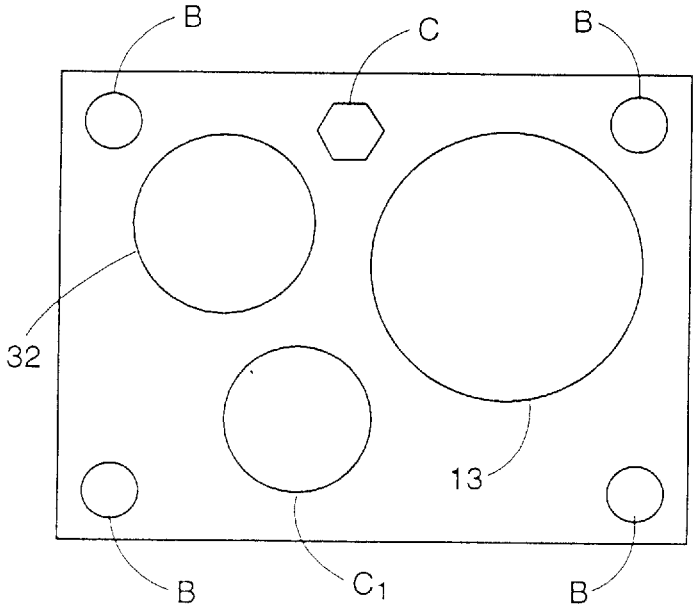
FIG. 5. is a plan view of the automatic golf ball washer caddy compartments.
Figure 6:
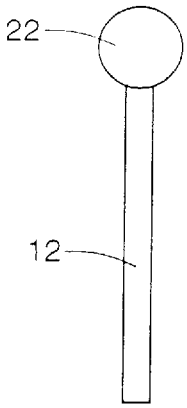
FIG. 6. is a front elevation of the shaft 12 and head 22.
Figure 7:
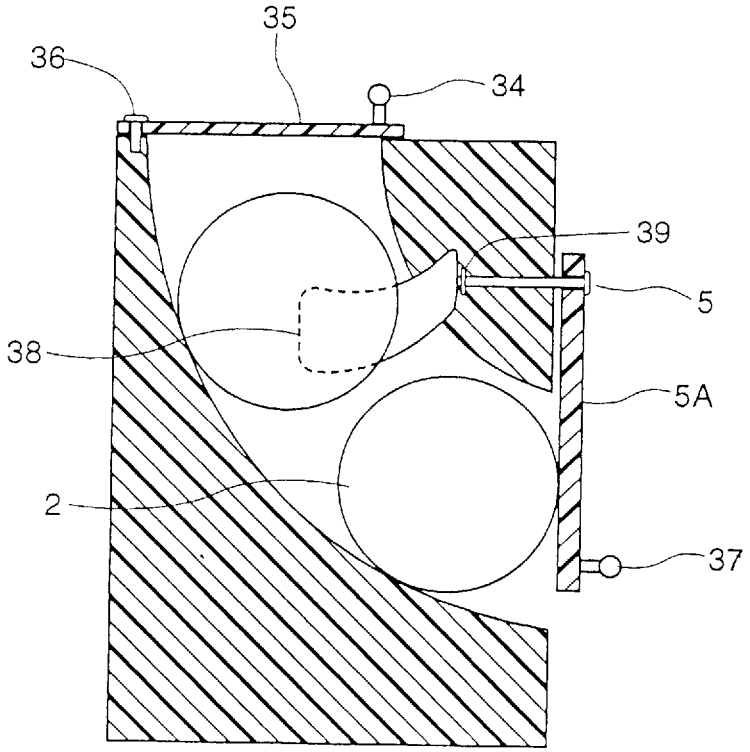
FIG. 7. is an end sectional view of the left side showing ball in storage chamber and stopper 38.
Figure 8:
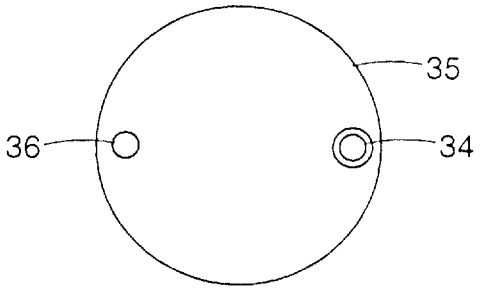
FIG. 8. is a plan view of the cover for the ball storage compartment.
Figure 9:
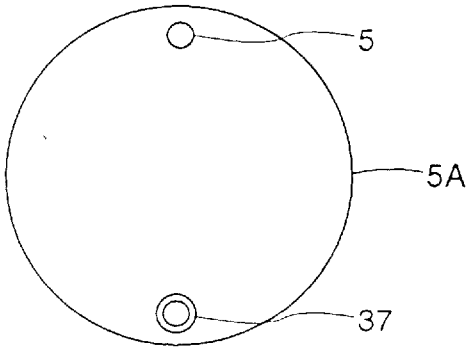
FIG. 9. is a front view of ball door cover "5A.
Figure 10:
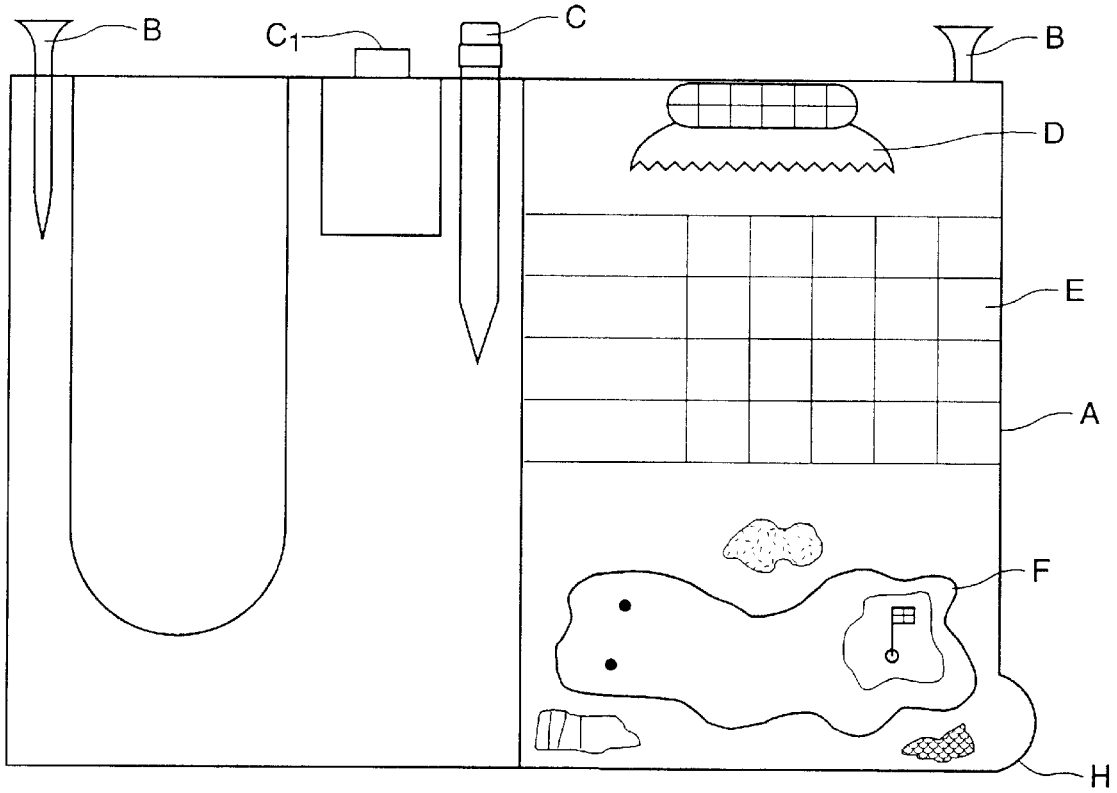
FIG. 10. is a sectional front view of ball washer detachable scoring board "A", scoring card "E", clip "D", decorated area "F", handle "H" to lift board, liquid solution "C1", tees "B" and pencil "C".
Figure 11:
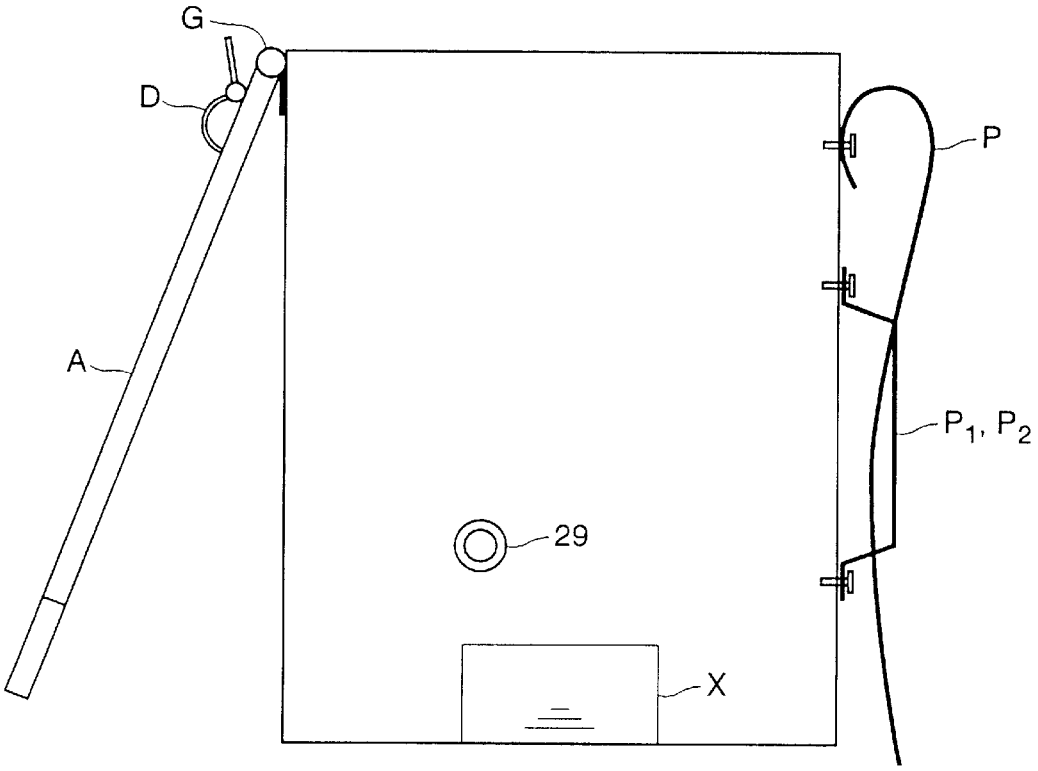
FIG. 11. is an end elevation view of the right side showing swinging clipboard "A", clip "D" for holding score cards hinge "G", clip "P" for hanging to objects, loops "P1 & P2" for attaching to objects, "X" denotes a door for battery compartment, and ring 29 to hang towels.
Figure 12:
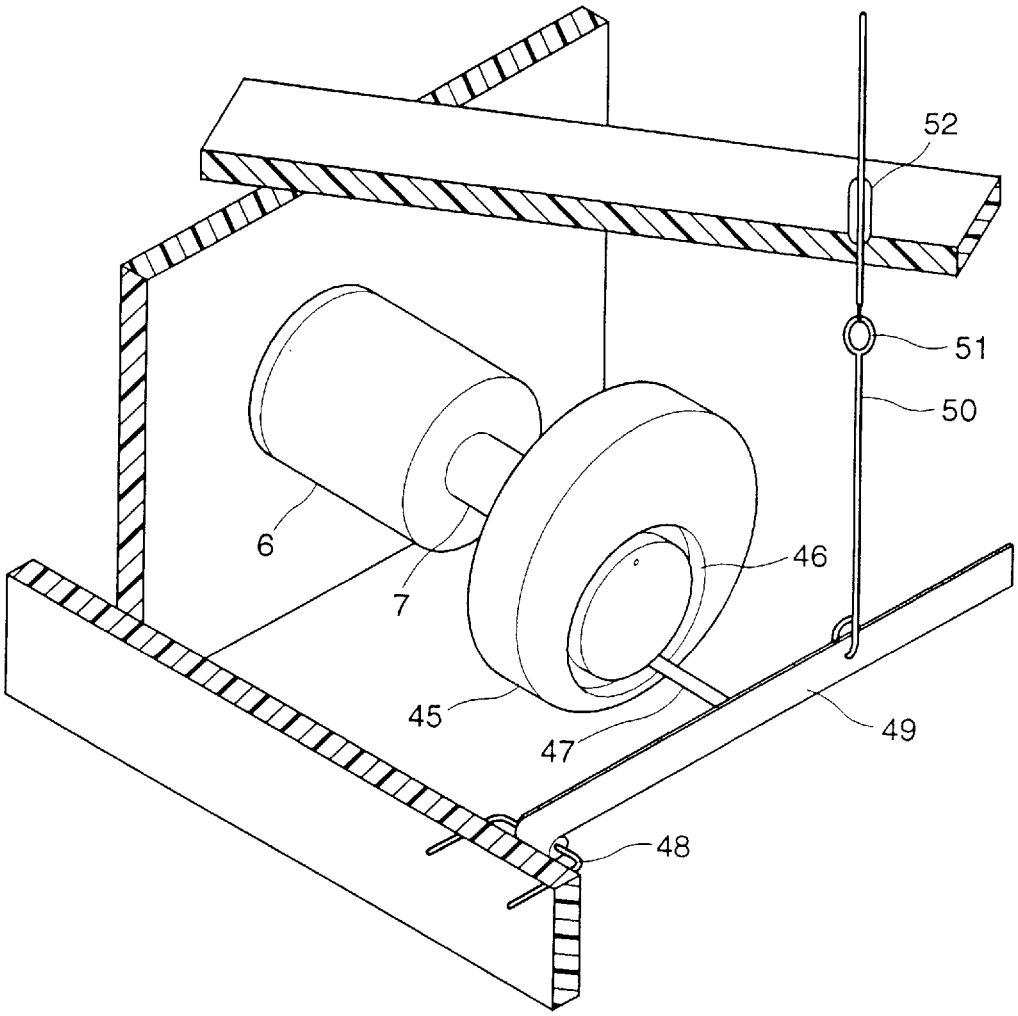
FIG. 12. shows an isometric projection view of an alternate method of motion for cleaning the golf ball or similar rounded object. The motor 6, turning shaft 7, that turns cam follower 45. The off-centered cam groove 46, has a cam 47, attached to cam follower shaft 49, which is held in place by clip 48. Attached to cam follower shaft 49, is a lifter shaft 50, a knuckle pin 51, that helps the shaft to travel straight upwards motion and this action is supported by a shaft lifter guide 52.
Figure 13:
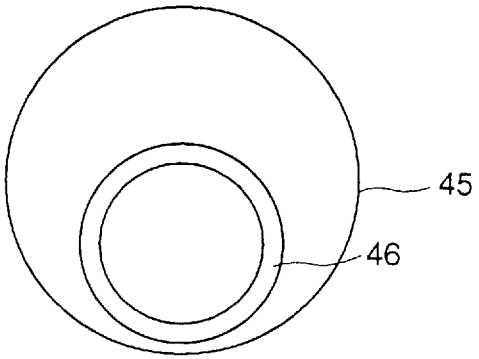
FIG. 13. is a front elevation view of cam follower.
Figure 14:
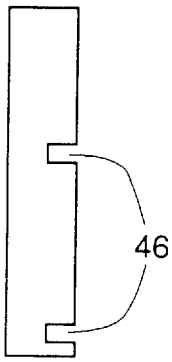
FIG. 14. is a sectional view of the cam follower groove.

2 is the golf ball in storage of compartment 32 in FIG. 1, & 7.
5 is the fastener that holds the stopper 5A. in position, in FIG. 7 & 9.
5A. is the ball stopper, in FIG. 7 & 9.
6 is the conventional motor in FIG. 1& 12.
is a specially designed step-down shaft in FIG. 1.
11 shows the cotter pin in FIG. 1.
12 shows a specially designed shaft with rounded head 22, in FIG. 3 & 6.
13 is a moulded housing with the ability to receive a removable sealed chamber in FIG. 4.
14 shows the sealed chamber with a flexible rubber bottom, in FIG. 4. This said chamber also known as a replaceable chamber.
16 is the seal under and around cover, in FIG. 2.
18 are the prongs suspended from the cover 23B to cradle 20, in FIG. 2.
20 is the cradle that holds the golf ball in the cleaning chamber, in FIG. 2.
21 is the flexible rubber diaphragm that fits tightly to the head of a shaft 22 in FIG. 3.
22 is the head of the shaft 12, in FIG. 3 &6.
23 is the male threaded opening in FIG. 3, to fit female thread 23A, in FIG. 2.
23A is the female threaded end in FIG. 2, to fit male opening 23, in FIG. 3.
23B is the specially designed cover for compartment 13, in FIG. 3.
24 is the return spring that forces the ball directly downward in FIG. 2.
25 is the passage way that allows the shaft 12 to pass through it, in FIG. 1.
26 shows the battery laying in its compartment, in FIG. 1.
27 is the electronic timer that will automatically shut off the motor, in FIG. 1.
28 is the switch that will work with the timer or direct on/off, in FIG. 1.
29 is the ring to fit a towel or other similar accessories, in FIG. 1 & 11.
31 are the brushes in the chamber staggered to assist rotation of the ball during cleaning, in FIG. 1 & 3.
32 is the compartment for storing golf balls 2, in FIG. 1 & 5.
34 is the handle of the cover for ball storage 35, in FIG. 1 & 7.
36 is the cover for ball storage, in FIG. 1 & 7.
36 is the fastener to secure the cover, in FIG. 1 & 7.
37 is the door handle for releasing ball, in FIG. 7 & 9.
38 is the stopper to prevent other balls from coming out, in FIG. 7.
39 is the fastener for stopper 38, in FIG. 7.
40 is a wall that divides motor and cleaning chamber, in FIG. 1.
41 is the outer walls of the cleaning chamber, in FIG. 1.
42 is the passage for draining liquid solution, in FIG. 1 & 3.
43 is the cover for the drain passage, in FIG. 1 & 3.
44 is a mount for the motor, in FIG. 1.
45 is the cam, in FIG. 12 & 13.
46 is the cam grooves, in FIG. 12, 13 & 14.
47 is the cam follower in FIG. 12.
48 is the holder for cam follower shaft in FIG. 12.
49 is the cam follower shaft in FIG. 12,
50 is the ball lifter in FIG. 12.
51 is the knuckle pin in FIG. 12.
52 is the guide for ball lifter in FIG. 12.

DETAILED DESCRIPTION OF THE INVENTION

The patent act imposed that the inventor describe a detail embodiment of the present invention, however it is to be noted that the detailed description is an example of the prior art which can be improvise in various forms.

Generally, the Automatic Golf Ball Washer Caddy is a unique invention that cleans golf balls and similar rounded objects. This cleaner is diverse by being both portable and stationary. A ball 2 is placed in a specially designed cradle 20 attached to cover 23B by means of prongs 18. This cover has a seal 16 completely around it to retain the liquid solution in cleaning chamber, With the ball in this position, it is therefore placed in the cleaning chamber 13 that is specially designed with a flexible diaphragm 21 at the bottom. The liquid solution can be dispensed through drain opening 43 without tipping the chamber. An alternate sealed chamber 14 is placed in the specially designed housing 13. The cleaning takes place when the cover 23B locked and sealed off chamber 14 and 13 respectively. The battery 26 or solar power (not shown) is used as a power supply to an electronic timer 27 and/or directly to a switch 28 wired conventionally. The motor 6 turns a special designed step-down shaft 7.

This special designed step-down shaft 7 has a hole toward one end to fit the cotter pin 11. This special shaft 7 turns the shaft 12 rounded at the top end 22. The shaft is guided through the specially designed housing passage 25 to allow the flexible diaphragm 21 to fit over its head 22. When the shaft 12 moves up, it pushes the ball 2 upwards against the specially designed brushes 31 and forced downwards by the spring 24. The brushes 31 are strategically staggered to improve rotation of the ball 2 to maximize cleaning. This golf ball cleaner has a compartment 32 to store golf balls. It is special designed to release one ball by a lever 37. A ball stopper 5A. is mounted by a fastener 5. The ball stopper 5A. can move from side to side. The balls are kept in place by cover 35.

An alternate means of cleaning golf balls or similar rounded objects will takes place when motor 6, turns shaft 7, which turns cam 45, which has an off-centered groove 46, to rotate cam follower 47. The said cam follower 47, is attached to cam follower shaft 49, which is held in place by clip 48. Attached to the cam follower shaft 49 is the ball lifter 50, which is kept in an upright motion by knuckle pin 51 and guider 52.

The housing maybe made of plastic or any other light-weighted materials that are simple and economical. The illustrations are only drawings and do not reflect the size of the outcome. All attachments and connections are either by pivots, screw, or welding and are done conventionally.

As previously illustrated, this invention an improved Automatic Golf Ball Washer and Caddy. It is obvious that the automatic golf ball cleaner is particularly useful because it provides an electronic timer for a complete automatic wash and a detachable scoring board for ease of writing scores. It also has several compartments for accessories such as tees, pencil, scoring cards and liquid cleaning solution.

"While this invention illustrated and described in details in the drawings and foregoing descriptions, the same is to be considered as illustrative and not restrictive in character. It is understood that only the preferred embodiments have been shown and described and that all changes and modifications that come within the spirit of invention are needed to be protected."

The invention claimed is:

1. A golf ball washer comprising:

(a) a housing having a clean chamber therein, said housing further includes a motor and means to supply electrical energy to said motor, said motor having a rotary output member;

(b) said cleaning chamber including a container therein, the container being open at the top portion thereof and having substantially rigid side walls and further including a flexible member at a bottom portion thereof, said container being capable of holding a quantity of cleaning liquid;

(c) a cover for covering the top portion of said container, said cover including sealing means for preventing any liquid in the container from leaking therefrom, said cover further including on a bottom portion thereof a ball biasing means and wherein said cover further includes a ball cradling means attached to the bottom portion thereof;

(d) brushing means affix to an inner wall of said container for cleaning the surfaces of a ball;

(e) a shaft mounted in the housing for linear reciprocating movement, means operably connected to the rotary output member of said motor and said shaft for converting the rotary motion of the rotary output member into linear reciprocating motion of the shaft, an end portion of the shaft is located beneath the flexible member of the bottom portion of the container such that the linear movement of the shaft cases a ball located within the container to move up and down while contacting the brushing means, the ball while being cleaned being located between the ball biasing means of the cover and the shaft.

2. The golf ball washer as defined in claim 1 wherein the housing further includes a storage compartment in which a plurality of balls may be stored therein.

3. The golf ball washer as defined in claim 2 wherein the storage compartment includes means to selectively release one ball at a time.

4. The golf ball washer as defined in claim 1 wherein the ball cradling means includes two prongs extending from said cover.

5. The golf ball washer as defined in claim 1 wherein the ball biasing means is a coil spring.

6. The golf ball washer as defined in claim 1 wherein the sealing means is a rubber sealing washer and the cover is provided with threads for removable attachment to the housing.

7. The golf ball washer as defined in claim 1 wherein the shaft has a hole in one end thereof for receiving a cotter pin, said cotter pin retaining the shaft on the rotary output member of the motor.

8. The golf ball washer as defined in claim 7 wherein the shaft has an enlarged ball-shaped head at a second end thereof.

9. The golf ball washer as defined in claim 1 wherein the housing includes areas for holding a pencil, golf tees and a quantity of soap solution.

10. The golf ball washer as defined in claim 1 wherein the housing further has a clipboard attached thereto.

11. The golf ball washer as defined in claim 1 wherein the housing has mounting means thereon for enabling it to be secured to another object.

12. The golf ball washer as defined in claim 1 wherein said container is fixed with respect to said housing.

13. The golf ball washer as defined in claim 1 wherein said container is removable from the housing.

14. The golf ball washer as defined in claim 12 wherein further comprising a drain connected to said container including means for draining any liquid therein.

15. The golf ball washer as defined in claim 1 wherein the motion converting means comprises a cam shaft having an eccentric groove therein and a cam follower engaged in said groove, said cam follower attached to a follower shaft which is secured to a portion of the housing, said linearly reciprocating shaft being operatively connected to said follower shaft.

16. The golf ball washer as defined in claim 1 wherein the motion converting means comprises a shaft having two laterally offset portions.

* * * * *